US005609280A

United States Patent [19]

Smith

[11] Patent Number: 5,609,280

[45] Date of Patent: Mar. 11, 1997

[54] BELT BUCKLE WITH TOOL CARRIER

[76] Inventor: Robert D. Smith, 2116 E. Cleveland Ave., Hobart, Ind. 46342

[21] Appl. No.: 497,906

[22] Filed: Jul. 3, 1995

[51] Int. Cl.[6] ..... A44B 11/00

[52] U.S. Cl. ..... 224/163; 224/904; 24/163 K; 7/168; D3/228

[58] Field of Search ..... 224/163, 904, 224/224, 225, 242, 251, 912, 924; 24/163 K; D11/200, 201; D3/228; 7/168, 138

[56] References Cited

U.S. PATENT DOCUMENTS

| | | | |
|---|---|---|---|
| D. 246,552 | 12/1977 | Baughman | D2/406 |
| D. 251,339 | 3/1979 | Tulak | D11/201 |
| 2,401,174 | 5/1946 | McAuley | 224/912 |
| 3,877,622 | 4/1975 | McLain | 224/924 |
| 4,068,787 | 1/1978 | Craighead | 224/26 E |
| 4,135,267 | 1/1979 | McKinney, Sr. et al. | 7/151 |
| 4,260,087 | 4/1981 | Leaver | 224/163 |
| 4,358,036 | 11/1982 | Maltais | 224/252 |
| 4,377,249 | 3/1983 | Bockoven | 224/163 |
| 4,481,712 | 11/1984 | Phelps | 224/163 |
| 4,498,612 | 2/1985 | Geekie, Jr. | 224/163 |
| 4,870,771 | 10/1989 | McClellan | 224/163 |
| 4,955,097 | 9/1990 | Roderer | 7/138 |

*Primary Examiner*—Henry J. Recla
*Assistant Examiner*—Gregory M. Vidovich
*Attorney, Agent, or Firm*—Gary M. Hartman; Domenica N. S. Hartman

[57] ABSTRACT

A belt buckle is provided that is uniquely designed for securely holding a plier-like tool, such that a wearer has ready access to the tool when needed. The belt buckle is particularly designed for use with a tool of the type exemplified by a handtool commercially available under the name VISE GRIPS, which is characterized by jaws operated by a pair of bi-stable arms. The belt buckle utilizes the jaws and the arms of the tool to secure the tool to the buckle in a manner that exploits the ability of such a tool to grip an object without slipping.

20 Claims, 1 Drawing Sheet

BELT BUCKLE WITH TOOL CARRIER

BACKGROUND OF INVENTION

1. Field of Invention

The present invention generally relates to an improved multipurpose belt buckle. More particularly, this invention relates to a belt buckle that is uniquely designed to allow a tool to be securely attached to it, such that the wearer of the belt buckle has ready access to the tool.

2. Description of Prior Art

Buckles adapted to secure opposite ends of a belt together are typically attached to a fixed end of the belt while being removably attachable to an oppositely-disposed adjustment end of the belt. Buckles are often removably attachable with a pivotable arm or hook that the wearer engages with one of several holes formed in the adjustment end of the belt. Generally, when a person is wearing a belt, the position of the belt buckle is usually in the front at waist level, which is an extremely convenient location for attaching articles that the wearer may wish to be accessible. As a result, numerous attempts have been made to provide belt buckles whose utility is enhanced by combining-other uses with them. For example, U.S. Pat. No. 4,068,787 to Craighead teaches a belt buckle with a cavity adapted for concealing paper money. U.S. Pat. No. 4,135,267 to McKinney, Sr., et al. teaches a belt buckle equipped with a bottle opener, a can opener, a blade along one edge and a fish scaler, yielding a belt buckle that is particularly suited for use by sportsmen. Finally, U.S. Pat. No. 4,377,249 to Bockoven teaches a belt buckle that is adapted to receive a revolver.

All of the above belt buckles suggest various additional uses for a belt buckle through the ability to securely attach another article to these buckles. As noted previously, the central location of a belt buckle enables an article carried by the buckle to be readily accessible for frequent use. For example, the belt buckles taught by McKinney, Sr. et al. and Bockoven enable the wearer to have ready access to various tools and a revolver, respectively. However, none of the belt buckles discussed above are capable of effectively securing a tool, and particularly of the type routinely used by mechanics, machinists and hobbyists while away from their tool supplies. Tools of this type generally have a multipurpose construction, and include various forms of pliers that are adapted to allow the user to grasp, adjust and remove components. An exemplary type of such a tool is commercially available under the name VISE GRIPS, though various manufacturers produce similar tools having comparable versatility. Those who frequently require the use of tools while away from their tool box will appreciate that this type of tool serves as a reliable alternate for specialty tools that are sized or designed for a specific function or purpose, but are so specialized as to have limited additional uses and are therefore typically not carried with the user.

Therefore, what is needed is a belt buckle that is adapted to secure a plier-type tool to the belt, while allowing the wearer ready access to the tool. Such a belt buckle would be extremely useful in applications where the wearer requires access to a versatile tool under circumstances where they are unlikely or unable to carry the tool in their hands. As a result, such a belt buckle would provide increased safety and efficiency to the wearer.

SUMMARY OF THE INVENTION

It is an object of this invention to provide a belt buckle to which a tool can be readily attached and removed, but can otherwise be used with a conventional belt.

It is another object of this invention to provide a belt buckle that is particularly adapted to secure a tool having a pair of jaws that are biased towards each other.

It is a further object of this invention that such a belt buckle have minimal weight yet reliably support and secure the tool.

In accordance with a preferred embodiment of this invention, these and other objects and advantages are accomplished as follows.

Generally, this invention relates to an improved multipurpose belt buckle that allows the wearer to attach a tool to the buckle in a manner that renders the tool readily accessible to the wearer. In particular, the belt buckle is designed for use with a tool having jaws and a pair of arms, such as a plier-type tool. More specifically, the belt buckle is configured to be used with a type of tool exemplified by a handtool commercially available under the name VISE GRIPS. Such tools are characterized by jaws operated by a pair of arms, in which one of the arms is a fixed arm with an adjustment feature while the other is a pivotable arm that is bi-stable between an open position and a closed position relative to the fixed arm. As such, the arms operate the jaws between two positions, One being a closed position in which the jaws are biased towards each other so as to be capable of generating a significant clamping or gripping force. The belt buckle of this invention utilizes the jaws and the arms of the tool to secure the tool to the buckle in a manner that exploits the intended operation of the tool, in that the jaws of a VISE GRIPS and similar tools are commonly designed to grip objects without slipping.

To achieve the above, the belt buckle of this invention is generally composed of a first feature for receiving one of the tool's pair of arms and a second feature for engagement with the jaws of the tool. The first feature is preferably in the form of a ring-like feature formed with or attached to the buckle, and has an opening for receiving one arm of the tool. The second feature is preferably in the form of a post that can be engaged by the jaws of the tool, such that the tool is securely retained on the belt buckle when the jaws are clamped onto the post. Preferably, the ting-like feature and the post are spaced relative to each other such that different-sized tools can be accommodated on the belt buckle. Finally, the belt buckle of this invention is adapted to be attached to a conventional type of belt, in which one end of the belt is provided with an array of holes with which the buckle can be selectively engaged.

In use, the tool is attached to the belt buckle by inserting one arm in the opening of the ring-like feature, and then operating the arms to clamp the jaws of the tool onto the post. Preferably, the opening of the ring-like feature receives the fixed arm of the tool, and is adapted to permit access to the adjustment feature on the fixed arm such that the clamping force generated by the jaws on the post can be suitably adjusted. When the wearer desires to use the tool, the wearer can simply and easily remove the tool from the belt buckle by rotating the arm of the tool not retained by the ring-like feature, such that the jaws release the post. In this manner, the invention provides a belt buckle to which a tool can be readily attached and removed by the wearer. Accordingly, the belt buckle enables a highly versatile tool, such as a VISE GRIPS or comparable handtool, to remain accessible by being carried on the belt of the user. The size and weight of the belt buckle is minimized by securing the tool to the buckle in a manner that exploits the clamping force applied by the jaws, and by restraining only one arm of the tool. The belt buckle of this invention securely maintains the tool in place while allowing the wearer to engage in activities that require the use of both hands, such as is common when working on equipment.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE PREFERRED EMBODIMENT

Figure 1:
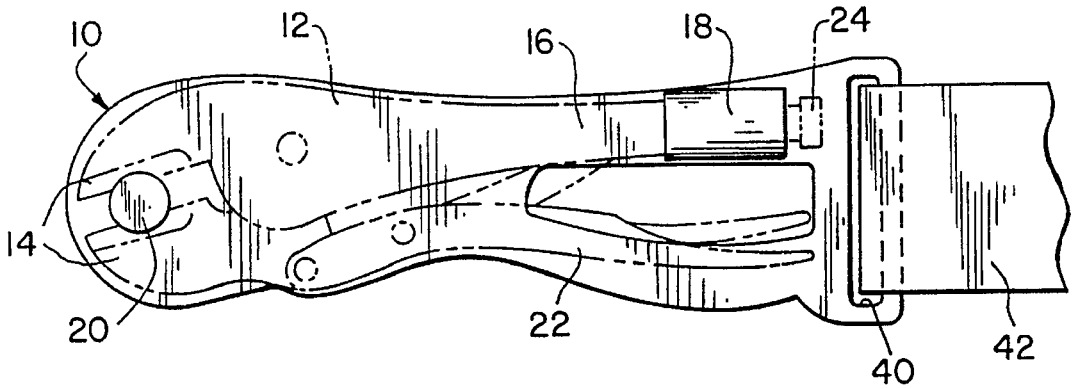
FIG. 1 shows a front view of a belt buckle to which a plier-like tool is attached in accordance with a first embodiment of this invention.
Figure 2:
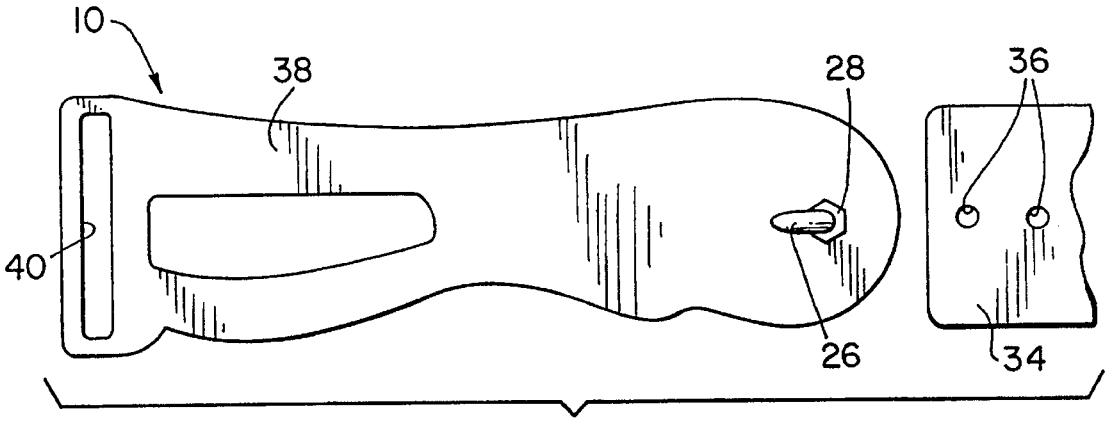
FIG. 2 shows a back view of the belt buckle of FIG. 1.
Figure 3:
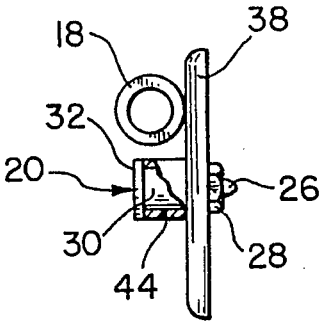
FIG. 3 shows a side view of the belt buckle of FIG. 1.

FIGS. 1 through 3 show a belt buckle 10 in accordance with a first embodiment of this invention. The buckle 10 supports a tool 12, shown in phantom in FIG. 1, of a type exemplified by a handtool that is commercially available under the name VISE GRIPS, though similar tools are also available from various manufacturers under other names. The buckle 10 of this invention is specially adapted to secure a tool 12 of the type shown in FIG. 1, which is generally characterized by jaws 14 operated by a pair of arms 16 and 22. As shown, one of the arms is a fixed arm 16 with an adjustment screw 24, while the other is a pivotable arm 22 that is bi-stable between an open position and a closed position relative to the fixed arm 16. As is known in the art, the arms 16 and 22 operate the jaws 14 between two positions, one being a closed position (represented in FIG. 1) in which the jaws 14 are biased towards each other so as to be capable of generating a significant clamping or gripping force. The open position for the jaws 14 corresponds to the open position of the arms 16 and 22, while the closed position for the jaws 14. The relationship between the relative positions of the arms 16 and 22 and the relative positions of the jaws 14 is made adjustable by the adjustment screw 24 on the fixed arm 16.

According to this invention, the belt buckle 10 utilizes the jaws 14 and the arms 16 and 22 of the tool 12 to secure the tool 12 to the buckle 10 in a manner that exploits the basic operation of the tool 12, while allowing the wearer ready access to the tool 12 as needed. As shown in FIG. 1, the buckle 10 generally includes a backplate 38 on which a sleeve 18 and a clamping post 20 are provided. The backplate 38, sleeve 18 and post 20 are preferably made of metal or another suitable material that is sufficiently rigid to support the tool 12. The backplate 38 is preferably formed to have an external shape similar to the external shape of the tool 12, as illustrated in FIG. 1, so as to provide adequate support for the tool 12 with a minimal amount of material, while simultaneously contributing an aesthetically pleasing appearance to the buckle 10. To further reduce its weight, the backplate 38 also preferably has a central opening as shown in FIGS. 1 and 2.

For attaching the belt buckle 10 to a belt, the buckle 10 is formed to have an aperture 40 at one end thereof by which the buckle 10 is secured to one end 42 of a belt in a conventional manner. FIG. 2 shows an opposite end 34 of the same belt shown in FIG. 1, and further shows a hook 26 formed on the corresponding end of the belt buckle 10. The hook 26 is engagable with holes 36 formed in the end 34 of the belt, as is also conventional.

The function of securing the tool 12 to the buckle 10 is performed by the sleeve 18 and post 20, as shown in FIG. 1. The sleeve 18 and post 20 are generally located at opposite ends in the longitudinal direction of the backplate 38, and serve to secure the tool's fixed arm 16 and the jaws 14, respectively, to the buckle 10. The post 20 is generally formed to have a core 30 with sufficient rigidity to support the weight of the tool 12 as well as sustain the clamping force generated by the tool 12 and applied by the jaws 14. As shown in FIGS. 2 and 3, the post 20 can be attached to the backplate 38 by a fastener 28 that also secures the hook 26 to the backplate 38. The core 30 preferably extends in an approximately perpendicular direction from the surface of the backplate 38, as shown in FIG. 3, and is surrounded by a sleeve 44 formed from plastic or another elastically-deformable material. The diameter of the sleeve 44 is such that the jaws 14 of the tool 12 will readily and securely grip the post 20 when the arms 16 and 22 are suitably adjusted by the adjustment screw 24 and in their closed position, as shown in FIG. 1. Correspondingly, the jaws 14 are releasable from the post 20 when opened by rotating the pivotable arm 22 relative to the fixed arm 16. A retaining shoulder 32 is preferably formed on the core 30 so as to secure the sleeve 44 on the core 30. Use of the fastener 28 to secure the core 30 to the backplate 38 enables the sleeve 44 and hook 26 to be replaced if desired.

Figure 4:
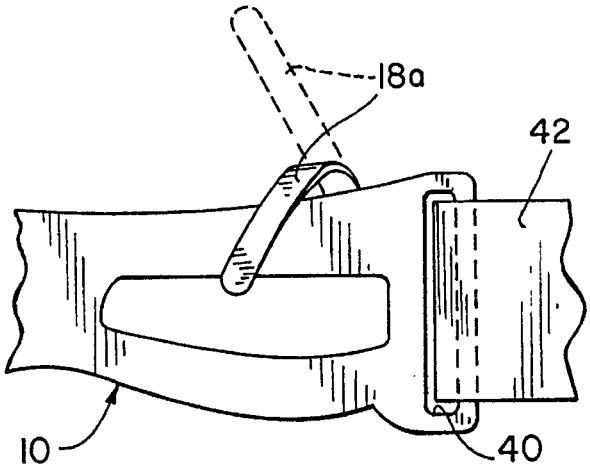
FIG. 4 shows a portion of a belt buckle in accordance with an alternative embodiment of this invention.

The sleeve 18 shown in FIGS. 1 and 3 is mounted to the backplate 38 on the same surface as the post 20. As shown, the sleeve 18 has a tubular shape, though any structure having an opening or passage sized to receive the fixed arm 16 of the tool 12 would generally be sufficient. Preferably, the sleeve 18 is sized to enable the adjustment screw 24 to project from the sleeve's passage, as shown in FIG. 1, in order to permit adjustment of the tool 12 while in position on the buckle 10. FIG. 4 illustrates an alternative embodiment of this invention, in which the sleeve 18 of FIG. 1 is replaced with an annular portion **18*a* formed integrally with the backplate 38. As originally stamped, the portion 18*a* extends from the backplate 38 roughly at a 45 degree angle as shown in phantom, and is subsequently bent back towards the front surface of the backplate 38, such that the distal tip of the portion 18*a* generally extends toward the opening formed in the backplate 38, as shown in FIG. 4. Alternatively, the distal tip of the portion 18*a* can be joined to the backplate 38 to yield a more rigid portion 18*a***.

Together the sleeve 18 (or portion **18*a*) and the post 20 cooperate to provide an extremely secure method for attaching the tool 12 to the belt buckle 10, while still enabling the tool 12 to be readily removed when the wearer of the buckle 10 so desires. In addition, the sleeve 18 cooperates with the post 20 to prevent the tool 12 from rotating about the longitudinal axis of the backplate 38. Most preferably, the sleeve 18 is located a distance from the post 20 such that the fixed arm 16 of the tool 12 will be circumferentially contained within the opening formed by the sleeve 18, yet permit the buckle 10 to be used with tools 12 of various sizes—for example, the sleeve 18 and post 22 can be located on the backplate 38 such that both 4 and 5 inch VISE GRIPS are attachable to the buckle 10**.

In use, the tool 12 can be attached to the belt buckle 10 by opening the arms 16 and 22 of the tool 12, inserting the fixed arm 16 into the sleeve 18, positioning the jaws 14 around the post 20, and then rotating the pivotable arm 22 toward the fixed arm 16 so as to lock the jaws 14 onto the post 20. If necessary, and while in position on the buckle 10, the tool 12 can be adjusted with the adjustment screw 24 to ensure that the jaws 14 generate a suitable clamping load on the post 20. While mounted on the belt buckle 10, the tool 12 is conveniently stored in an accessible location, yet is sufficiently secluded so as to avoid interfering with the wearer's various activities. When the wearer desires to use the tool 12, he or she can simply and easily rotate the pivotable arm 22 away from the fixed arm 16, thereby releasing the jaws 14 from the post 20. As such, the wearer of the buckle 10 of this invention is permitted to have his or her hands free until such time that the tool 12 is required, at which point the wearer can readily remove the tool 12 from the buckle 10. Furthermore, the wearer of the belt buckle 10 is also able to work with increased efficiency, since he or she is not required to search for the tool 12 or return to a place where the tool 12 would otherwise be stored.

While this invention has been described in terms of a preferred embodiment, it is apparent that other forms could be adopted by one skilled in the art, for example by modifying the appearance or construction of the belt buckle 10. Accordingly, the scope of our invention is to be limited only by the following claims.

The embodiments of the invention in which an exclusive property or privilege is claimed are defined as follows:

1. A belt buckle adapted for securing a tool having a pair of jaws biased toward a closed position by a pair of arms, the belt buckle comprising:

a body having a first axis and a second axis transverse to the first axis;

a fixed stationary means associated with the body for receiving a first arm of the pair of arms of the tool, the receiving means being adapted to retain the first arm so as to limit movement of the first arm in two opposing directions substantially parallel to the second axis yet enable the first arm to be removable from the receiving means as the tool is moved relative to the body in a direction substantially parallel to the first axis wherein said receiving means remains stationary as the first arm is removed therefrom;

means associated with the body for engagement with the jaws of the tool, the engagement means having a surface oriented substantially normal to the body so as to enable the jaws of the tool to be biasingly clamped thereon when the jaws are in the closed position and the first arm is retained within the receiving means such that the tool is securely retained on the belt buckle; and means associated with the body for attaching the belt buckle to a belt;

wherein the engagement means and the receiving means are oppositely disposed on the body in the direction substantially parallel to the first axis so as to orient the tool to be approximately parallel to the first axis.

2. A belt buckle as recited in claim 1, wherein the surface of the engagement means is elastically-deformable when engaged by the jaws of the tool.

3. A belt buckle as recited in claim 1, wherein the surface is formed by a cylindrical sleeve.

4. A belt buckle as recited in claim 1, wherein the receiving means comprises a single sleeve for receiving the first arm of the tool, the belt buckle being configured to not restrain movement of a second arm of the pair of arms.

5. A belt buckle as recited in claim 1, wherein the engagement means comprises a post oriented to be substantially perpendicular to the body.

6. A belt buckle as recited in claim 1, wherein the engagement means comprises:

a cylindrically-shaped member; and a sleeve circumferentially surrounding the cylindrically-shaped member, the sleeve providing the surface with which the jaws are engagable.

7. A belt buckle as recited in claim 1, wherein the attaching means comprises a fixed belt mounting device at one end of the belt buckle, and a hook at an opposite end of the belt buckle.

8. A belt buckle as recited in claim 1, wherein the body has a peripheral shape substantially congruent to an external outline of the tool.

9. A belt buckle as recited in claim 1, wherein the body, the engagement means, and the receiving means are formed from a metal.

10. A belt buckle as recited in claim 1, wherein the receiving means and the engagement means are spaced relative to each other such that different-sized tools are accommodatable on the belt buckle.

11. A belt buckle as recited in claim 1, wherein the receiving means is adapted to permit adjustment of the first arm retained therewith.

12. A belt buckle adapted for securing a tool having jaws, a fixed arm and a pivotable arm that is bi-stable between an open position and a closed position relative to the fixed arm, the jaws having a first position in which the jaws are spaced apart corresponding to the open position of the pivotable arm, the jaws having a second position corresponding to the closed position of the pivotable arm, the jaws being disposed closer together in the second position as compared to the first position, the belt buckle comprising:

a body having a surface with a length in a longitudinal direction and a width in a transverse direction to the longitudinal direction;

a fixed, stationary means disposed at the surface of the body for receiving the fixed arm of the tool, the receiving means being adapted to retain the fixed arm so as to substantially prevent movement of the fixed arm in directions substantially perpendicular to the longitudinal direction yet enable the fixed arm to be removable from the receiving means as the tool is moved relative to the body in the longitudinal direction wherein said receiving means remains stationary as the fixed arm is removed therefrom;

means disposed at the surface of the body for engagement with the jaws of the tool, the engagement means having a surface oriented substantially normal to the surface of the body so as to enable the jaws of the tool to be biasingly clamped thereon when the jaws are in the closed position and the fixed arm is retained within the receiving means such that the jaws grip the engagement means and secure the tool to the body; and means associated with the body for attaching the belt buckle to a belt;

wherein the engagement means and the receiving means are oppositely disposed on the body in the longitudinal direction so as to orient the tool to be approximately parallel to the longitudinal direction of the body.

13. A belt buckle as recited in claim 12, wherein the receiving means comprises an arcuate portion integrally formed on the body so as to form an opening sized to receive the fixed arm of the tool.

14. A belt buckle as recited in claim 12, wherein the engagement means comprises:

a cylindrically-shaped member; and an elastically-deformable sleeve circumferentially surrounding the cylindrically-shaped member, the sleeve providing the surface with which the jaws are engagable.

15. A belt buckle as recited in claim 12, wherein the receiving means comprises a cylindrical sleeve attached to the body.

16. A belt buckle as recited in claim 12, wherein the attaching means comprises a fixed belt mounting device at one end of the belt buckle, and a hook at an opposite end of the belt buckle.

17. A belt buckle as recited in claim 12, wherein the body has a peripheral shape substantially congruent to an external outline of the tool.

18. A belt buckle as recited in claim 12, wherein the receiving means and the engagement means are spaced relative to each other such that different-sized tools are accommodatable on the belt buckle.

19. A belt buckle as recited in claim 12, wherein the receiving means is adapted to permit adjustment of the fixed arm retained therewith.

20. A belt buckle comprising:

a tool having jaws, a fixed arm having an adjustment feature and a pivotable arm that is bistable between an open position and a closed position relative to the fixed arm, the jaws having a first position in which the jaws are spaced apart corresponding to the open position of the pivotable arm, the jaws having a second position corresponding to the closed position of the pivotable arm, the jaws being disposed closer together in the second position as compared to the first position;

a body having a surface from which the tool is supported, the body having a peripheral shape corresponding to an external outline of the tool;

an arcuate portion integrally formed on the body so as to form an opening in which the fixed arm of the tool is received, the arcuate portion retaining the fixed arm so as to enable the fixed arm to be removable from the arcuate portion and so as to enable access to the adjustment feature of the fixed arm;

means disposed at the surface of the body and engaged with the jaws of the tool, the engagement means having a surface oriented substantially normal to the surface of the body with which the jaws are engaged when the jaws are in the second position such that the jaws grip the engagement means and secure the tool to the body, the engagement means being spaced apart from the arcuate portion such that different-sized tools are accommodatable on the belt buckle; and means associated with the body for attaching the belt buckle to a belt;

wherein the jaws of the tool are engagable and disengagable with the engagement means while the fixed arm remains retained by the arcuate portion.

* * * * *